US006252506B1

(12) United States Patent
Hsieh et al.

(10) Patent No.: US 6,252,506 B1
(45) Date of Patent: Jun. 26, 2001

(54) DEVICE FOR FINDING A POSITION OF A HUMAN

(75) Inventors: Yuan-Tai Hsieh, No. 28, Lane 32, Yung Hua Road, Yung Kang; Kun-Huei Chen, both of Tainan Hsien; Chien-Min Cheng, Tainan, all of (TW)

(73) Assignee: Yuan-Tai Hsieh, Tainan Hsien (TW)

( * ) Notice: Subject to any disclaimer, the term of this patent is extended or adjusted under 35 U.S.C. 154(b) by 0 days.

(21) Appl. No.: 09/401,541

(22) Filed: Sep. 22, 1999

(51) Int. Cl.[7] ..... G08B 13/00

(52) U.S. Cl. ..... 340/541; 340/565; 340/545.3; 250/338.3

(58) Field of Search ..... 340/541, 565, 340/545.3, 552; 250/338.1, 338.3, 339.05, DIG. 1

(56) References Cited

U.S. PATENT DOCUMENTS 5,281,818 * 1/1994 Tomita et al. ..... 250/347
5,473,368 * 12/1995 Hart ..... 348/155
5,528,038 * 6/1996 Yoshiike et al. ..... 250/342
5,877,688 * 3/1999 Morinaka et al. ..... 340/584
5,910,767 * 6/1999 Frucht ..... 340/557

* cited by examiner

*Primary Examiner*—Daniel J. Wu
*Assistant Examiner*—Toan Pham
(74) *Attorney, Agent, or Firm*—Rosenberg, Klein & Lee

(57) ABSTRACT

A device for finding a position of a human comprises a micro controller, a pyro-electrical infrared sensing unit, a first motor, a rotating speed feed back unit, an ultrasonic sensing unit and a second motor. The infrared sensing unit is fitted to an edge of a disc coupled to the shaft of the first motor. The rotating speed feed back unit has a rotating disc which is also coupled to the shaft of the first motor. The ultrasonic sensing unit is fitted to an edge of a second disc coupled to the shaft of the second motor such that it can move with rotating of the second disc. The micro controller activates the first motor and the infrared sensing unit to search for a human, and figures out the direction of that human by means of the rotating speed feed back unit. At the same time, the controller activates the second motor for the ultrasonic unit to be directed to the found human; thus, the distance from that human to the device is available.

3 Claims, 3 Drawing Sheets

DEVICE FOR FINDING A POSITION OF A HUMAN

BACKGROUND OF THE INVENTION

The present invention relates to a device for finding position of a human, which can detect the approach of a human, and find the direction and distance of that human.

Many scientists and inventors have made a lot of new machines, tool and devices with which we can lead a convenient and comfortable life. A device which can find position of a human body can be used in many ways, e.g. for finding position of a performer on the stage and then automatically adjusting the position or direction of the spotlight with movement of the performer with this purpose and others, the inventor of the present invention invented a device for finding position of a human body.

SUMMARY

The present invention relates to a device for finding position of a human, which can detect the approach of a human, and find the direction and distance of that human.

The device for finding position of a human of the present invention comprises:

(a) a micro controller having input and output ports;

(b) a pyro-electrical infrared sensing unit electrically connected to the micro controller;

(c) a first motor connected to the micro controller, the motor having a shaft connected to a first disc for permitting the disc to rotate with the shaft; the infrared sensing unit being fitted to the disc of the first motor such that the infrared sensing unit can make circular movement;

(d) a rotating speed feed back unit electrically connected to the micro controller, the feed back unit consisting of:

(i) a rotating disc connected to the first motor shaft, the rotating disc having a plurality of through holes circularly spaced apart thereon;

(ii) a photo-coupling unit including a transmitter and a receiver; the transmitter and the receiver being arranged at two sides of the rotating disc, opposing each other, directing a circle defined by the through holes for permitting the receiver to regularly receive messages from the transmitter while the rotating disc is rotating; the micro controller being thus able to figure out direction of the infrared sensing unit when same senses a human;

(e) a distance sensing unit electrically connected to the micro controller, the distance sensing unit being coupled to a disc rotatable with a shaft of a second motor; the second motor turns for permitting the distance sensing unit to direct the human and figures out the distance from that human when the infrared sensing unit finds the human.

The position finding device can be connected to a load such as a spotlight; thus, the spotlight can be adjusted to direct to a performer on the stage once the position finding device has found the performer.

BRIEF DESCRIPTION OF THE DRAWINGS

The present invention will be better understood by reference to the accompanying drawings, wherein.

DETAILED DESCRIPTION OF THE EMBODIMENT

Figure 1:
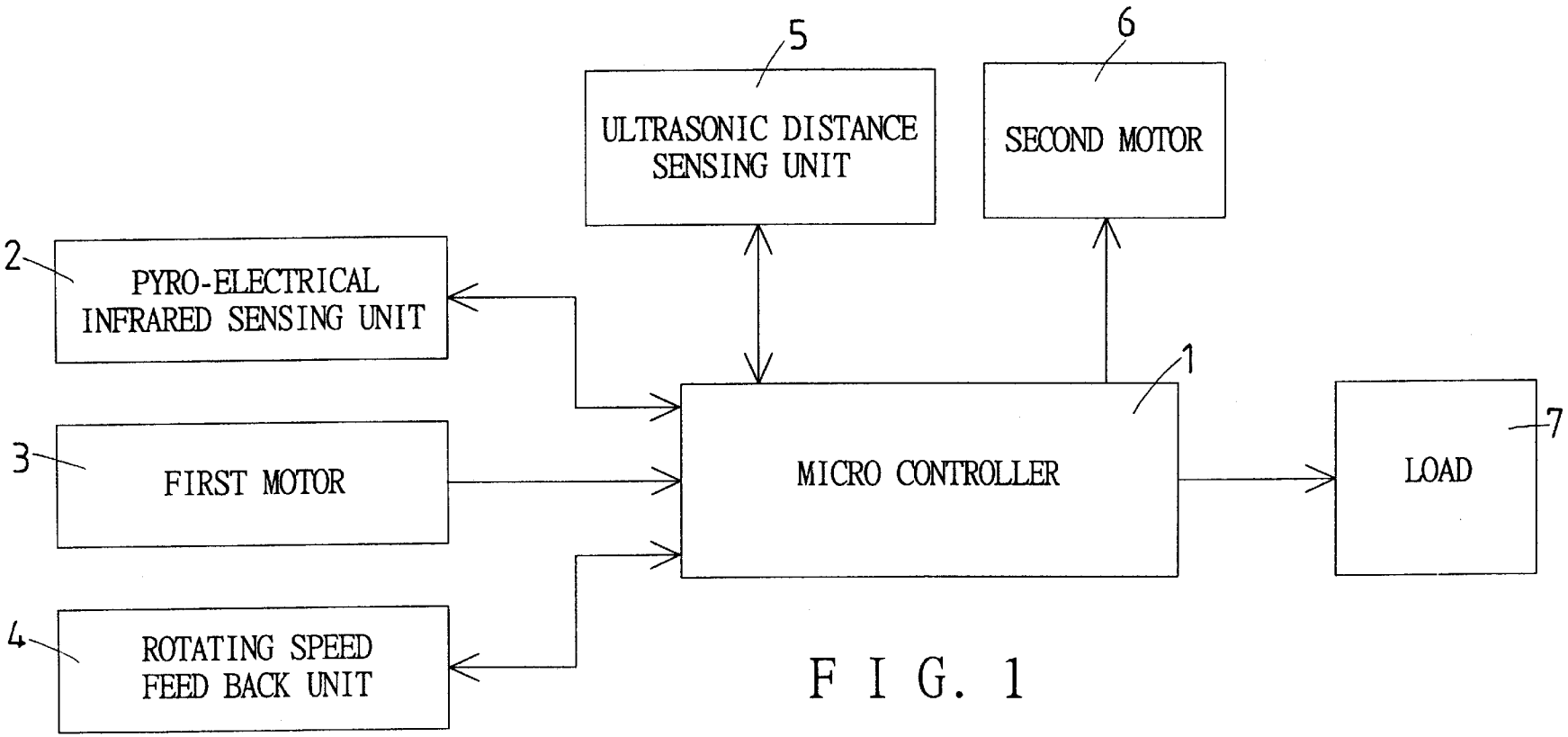
FIG. 1 is a block digram of the circuit of a device for finding position of a human body according to the present invention.
Figure 4:
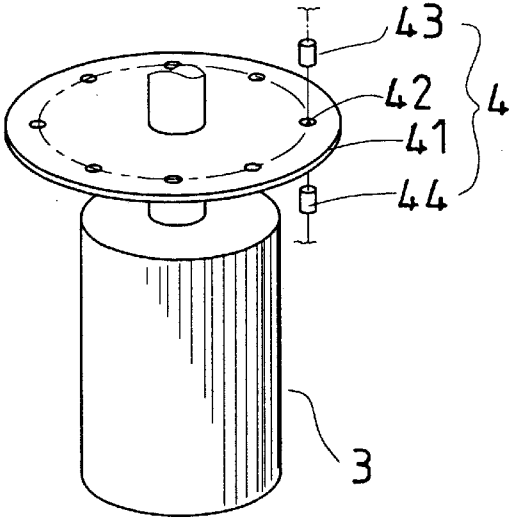
FIG. 4 is a view of the rotating speed feed back unit and the first motor of the present invention.
Figure 3:
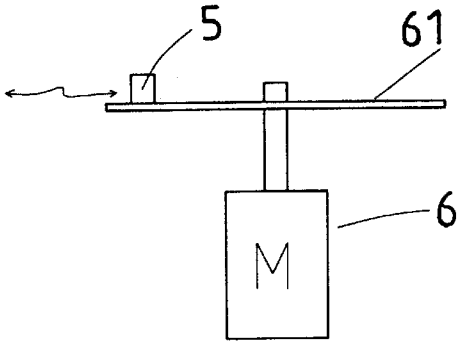
FIG. 3 is a front view of the ultrasonic sensing unit and the second motor of the present invention.
Figure 2:
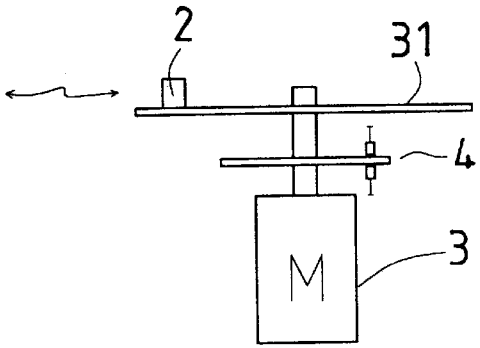
FIG. 2 is a front view of the infrared sensing unit, the first motor and the related parts of the present invention.

A device for finding a position of a human body of the present invention, referring to FIGS. 1,2 and 3, comprises a micro controller 1, pyro-electrical infrared sensing unit 2, a first motor 3, a rotating speed feed back unit 4, an ultrasonic distance sensing unit 5 and a second motor 6. The above components 2,3,4,5,6 are connected to input/output ports of the micro controller 1.

The first motor 3 has a shaft, to which a first disc 31 and a rotating disc 41 are fitted as shown in FIG. 2. The pyro-electrical infrared sensing unit 2 is coupled to the first disc 31 such that the disc 31 can make circular movement with the disc 31. The rotating speed feed back unit 4 includes the rotating disc 41, and a photo-coupling unit consisting of transmitter 43, and a receiver 44. The transmitter 43 and the receiver 44 are electrically connected to the micro controller 1.

Furthermore, the rotating disc 41 has a plurality of through holes 42 circularly spaced apart near an edge thereof. The transmitter 43 and the receiver 44 are arranged opposing each other on two sides of the disc 41 and directing the circular line defined by the through holes 42 such that the micro controller 1 can figure out the position of the disc 41; the receiver 44 will receive the message of the transmitter 43 regularly for a fixed period of time when the rotating speed of the disc 41 is constant. Therefore, the micro controller 1 can figure out the position of the disc 41 according to the number of the through holes 42 and the rotating speed.

The second motor 4 has a shaft, to which a second disc 61 is fitted. The ultrasonic sensing unit 5 is coupled to the second disc 61 such that the sensing unit 5 can move together with the disc 61.

In using the device for finding position of a human body, the micro controller 1 activates the first motor 3, and the pyro-electrical infrared sensing unit 2; thus, the first disc 31 will rotate and the infrared sensing device 2 will make circular movement while searching for a human body. When the infrared sensing device 2 finds a human, same will notice the micro controller 1 for the micro controller to figure out the direction of that human by means of the rotating speed feed back unit 4. At the same time, the micro controller 1 activates the second motor 6 to turn for adjusting the direction of the ultrasonic sensing unit 5; thus, the ultrasonic sensing unit 5 can direct that human and find the distance from that human. Thus, the direction and distance of that human is found.

Figure 6:
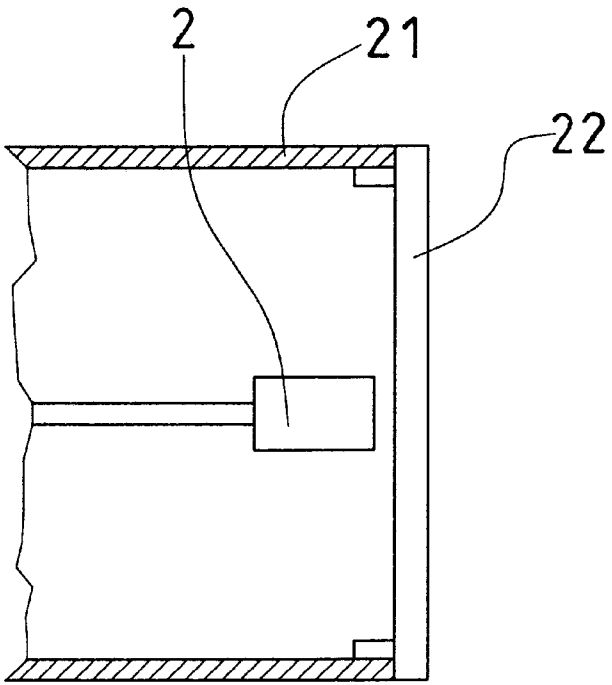
FIG. 6 is another cross-sectional view of the cover for the infrared sensing unit of the present invention.
Figure 5:
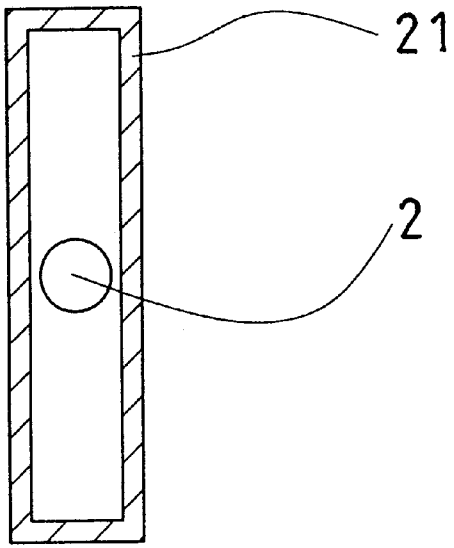
FIG. 5 is cross-sectional view of the cover for the infrared sensing unit of the present invention.

Referring to FIGS. 5 and 6, the infrared sensing unit 2 is provided with a housing 21 which is long from top of bottom and short from left to right. A lens 22 is coupled to a front side of the housing 21; the lens 22 can condense light from both upper and lower sides, and prevent at least a part of light from entering from both left and right sides in order for the device of the present invention to precisely find the position of a human.

Referring again FIG. 1, a load 7 is connected to the micro controller 1. For instance, the load 7 can be a spotlight. Thus, the spotlight can be immediately adjusted according to the needs, and directed to a performer on the stage once the device of the present invention has found the position of the performer.

What is claimed is:

1. A device for finding a position of a human comprising:

(a) a micro controller, said controller having a plurality of input and output ports;

(b) a pyro-electrical infrared sensing unit electrically connected to said micro controller from a corresponding one of said ports;

(c) a first motor electrically connected to said controller, said first motor having a first disc connected to a shaft thereof, said first disc being capable of rotating together with said shaft, said infrared sensing unit being fitted to said disc of said first motor for permitting same to move circularly with said first motor shaft;

(d) a rotating speed feed back unit electrically connected to said micro controller;

(e) a distance sensing unit electrically connected to said controller, including, (i) a ultrasonic sensing unit;

(ii) a second motor having a shaft, and a second disc coupled to said second motor shaft; said ultrasonic sensing unit being fitting to said second disc for permitting same to move together with said second motor disc, whereby said micro controller can figure out a direction of a human by means of said rotating speed feed back unit once said infrared sensing unit finds that human, and said ultrasonic sensing unit can be directed to said human to find a distance from said human.

2. The device for finding a position of a human as claimed in claim 1, wherein said infrared sensing unit is provided with a housing which is long from a top to a bottom, and short from a left side to a right side; said housing having a lens fitted to a front side thereof; said lens being capable of condensing light from both upper and lower sides, and blocking at least a part of light from both right and left sides.

3. The device for finding a position of a human as claimed in claim 1, wherein said rotating speed feed back unit consists of:

(a) a rotating disc connected to said first motor shaft, said rotating disc having a plurality of through holes circularly spaced apart thereon;

(b) a photo-coupling unit including a transmitter, and a receiver; said transmitter and said receiver being arranged at two sides of said rotating disc, opposing each other, directing a circle defined by said through holes, whereby said receiver being capable fo regularly receiving messages from said transmitter while said rotating disc is rotating for said micro controller to figure out a direction of said infrared sensing unit once said infrared sensing unit finds a human.

* * * * *